United States Patent [19]

Fisher

[11] 4,030,150

[45] June 21, 1977

[54] COMBINATION HAND TOOL

[75] Inventor: Lloyd R. Fisher, Longmont, Colo.

[73] Assignee: Joe W. Page, Jr., Huntington Beach, Calif.

[22] Filed: Dec. 24, 1975

[21] Appl. No.: 644,096

[52] U.S. Cl. ..... 7/15; 7/8.1 R; 7/13 R

[51] Int. Cl.[2] ..... B25B 1/00

[58] Field of Search ..... 7/8.1 R, 13 R, 1 R, 7/15, 1 B

[56] References Cited

UNITED STATES PATENTS

| | | | |
|---|---|---|---|
| 660,204 | 10/1900 | Seelye | 7/8.1 R |
| 810,987 | 1/1906 | Spicer | 7/15 |
| 1,441,903 | 1/1923 | Balaziuk | 7/8.1 R |
| 2,695,450 | 11/1954 | Platts | 7/8.1 R |
| 3,588,931 | 6/1971 | Jones | 7/15 |

*Primary Examiner*—Al Lawrence Smith
*Assistant Examiner*—Roscoe V. Parker
*Attorney, Agent, or Firm*—John E. Reilly

[57] ABSTRACT

An improved combination hand tool is designed for interchangeable use in different applications, such as for instance, as a hatchet, hammer, knife, saw or dressing tool and is characterized by including a non-slip grip handle having a dressing tool at one end to aid in the skinning of game or animals and a socket portion at the opposite end to permit detachable connection of a plurality of interchangeable implements or tool attachments, the handle being provided with shoulders at opposite ends both to shield the hand from injury and to effect more positive, firm engagement between the handle and each tool secured thereto.

4 Claims, 5 Drawing Figures

COMBINATION HAND TOOL

BACKGROUND OF THE INVENTION

This invention relates to novel and improved hand tools and more particularly to a combination, interchangeable hand tool including a non-slip grip handle designed for maximum safety and efficiency in use and characterized by a plurality of interchangeable head attachments securely but releasably affixed at the end of the handle.

Currently, the hand tools in use have not been very satisfactory from the standpoint of permitting interchangeable attachment of different tools in a secure manner so as to prevent accidental loosening or turning of the tool in use. Further, the tool handles have not permitted a firm grip and adequately protected the hand from accidental slipping and engagement with a cutting edge or other portion of the tool.

The present invention reduces this potential danger significantly and meets the safety requirements necessary for the safe use of a combination hand tool and additionally is an easier tool to use than those presently available.

SUMMARY OF THE INVENTION

In accordance with the present invention, a preferred form of hand tool is specifically adapted for use by the outdoorsman and employs a non-slip handle provided with shoulders at opposite ends of the gripping portion to shield the hand from injury, the shoulder at the forward end of the handle being so constructed and arranged as to cooperate with a socket in the forward extremity of the handle to interchangeably receive and permit secure attachment of various implements such as a hatchet hammer head or knife-saw. The enlarged shoulder at the forward end of the handle is provided with a squared or flat end surface to frictionally engage a correspondingly formed end surface of an enlarged shoulder portion formed on each tool or implement whereby to minimize the possibility of accidental loosening or disengagement of the implement once connected. At the opposite end, the enlarged shoulder on the handle converges or tapers rearwardly into an offset portion having a reverse curved, forwardly directed knife edge which terminates in a beveled, pointed end portion at its forward extremity, the latter serving as a dressing tool and specifically adapted for use in dressing game or animals. In this manner, when the handle is grasped, the enlarged shoulder portions will shield the hand from accidental engagement either with the dressing tool at one end or the implement affixed to the opposite end.

BRIEF DESCRIPTION OF THE DRAWINGS

The above and other objects, advantages and features of the present invention will become more readily understood and appreciated from the following description of a preferred embodiment thereof when taken together with the accompanying drawings in which.

DETAILED DESCRIPTION OF THE PREFERRED EMBODIMENT

Figure 1:
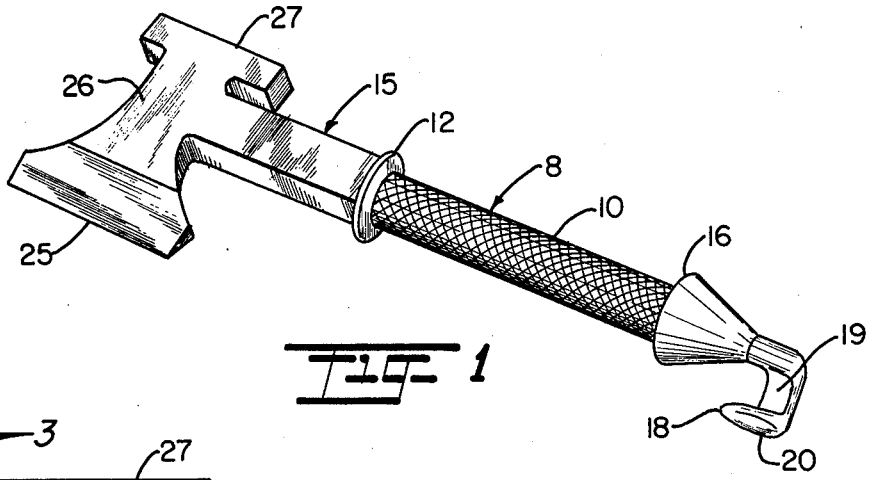
FIG. 1 illustrates, in perspective, the combination tool of the present invention as assembled with the hatchet-hammer head attachment at the forward end of the handle and the dressing tool at the opposite end.

Referring now to the drawings, wherein like numerals indicate like elements throughout the several views, a preferred embodiment of the combination hand tool device comprising the subject matter of the present invention is generally designated by the number 8 comprising a handle 10 to which interchangeable head attachments 15, 17 are secured.

The handle 10 preferably has a solid cylindrical knurled section 11, an external annular shoulder portion 12 at the forward end which is provided with opposed flat or squared end surfaces 13 and 13', and the forward terminal end or extremity has an internally threaded socket or counterbore 14. The opposite end of handle 10 also has an external shoulder portion 16 which converges or tapers rearwardly in generally conical fashion and extends into a lateral offset 20 provided with a reverse curved forwardly directed knife edge 19 terminating in a beveled, slightly pointed end portion 18 also extending in a forward direction. The lateral offset 20 is specifically adaptable for use as a dressing tool for game or animals. For example, by grasping handle 10, the nose or pointed end portion 20 may be inserted beneath the animal's skin or into the stomach liner and advanced toward oneself cutting the skin by means of knife edge 19. A particular advantage resides in the construction and shape of the nose or pointed end portion 20 to project forwardly of the knife edge 19 and parallel to the handle so as to prevent slipping out of the skin or stomach liner; and in cutting the liner of the stomach will separate the intestines from the stomach lining so as to prevent cutting of the intestine.

Figure 2:
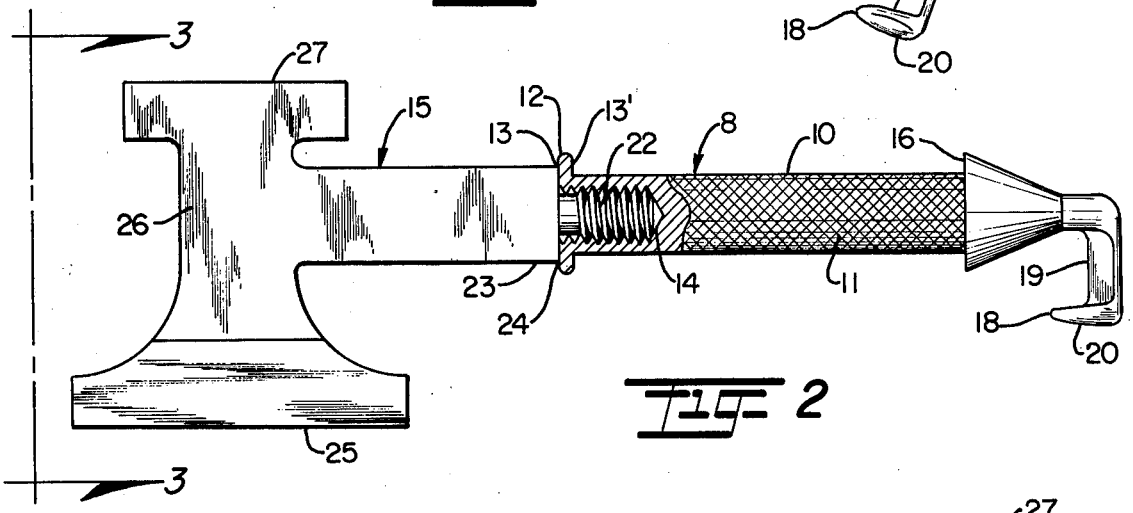
FIG. 2 is a fragmentary sectional view taken substantially along line 2—2 of FIG. 1 illustrating means for affixing a hatchet-hammer head attachment thereto.
Figure 3:
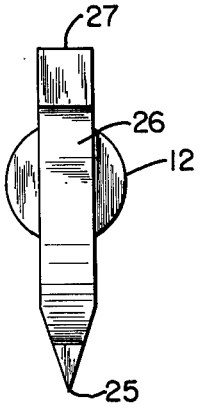
FIG. 3 is a plan view of the tool as shown in FIG. 2.
Figure 4:
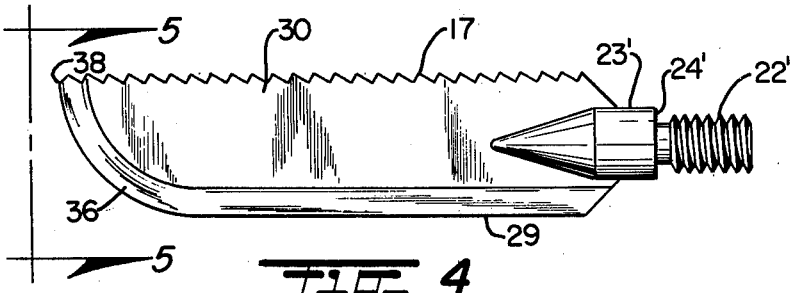
FIG. 4 illustrates another embodiment of the tool combination of the present invention with a combination knife-saw head attachment disassembled.
Figure 5:
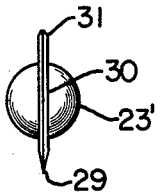
FIG. 5 is a plan view of the head attachment as shown in FIG. 4.

In the preferred embodiment as shown in FIGS. 1 and 2, implements which can be interchangeably attached may be best typified by a hatchet-hammer head attachment 15 with integral hammer portion 27, body portion 26 and blade portion 25, respectively, the latter disposed perpendicular to handle 10 and parallel to offset 18. Body portion 26 is provided with an enlarged shoulder portion 23 having a flat or squared end surface 24 with a threaded male connecting portion 22 which is secured to handle 10 by full insertion and threaded engagement of the portion 22 with internally threaded socket 14 until the end surface 13 of shoulder 12 advances into firm frictional engagement with the squared end surface 24 of shoulder 23 as shown in FIG. 2. If desired, the shoulder portion 23 may be enlarged somewhat adjacent to the squared end surface 24 so as to increase the effective surface area which frictionally engages the end surface 13.

Another variation of an implement usable in combination with the handle is a knife-saw head attachment 17 in place of the attachment 15 wherein knife-saw head attachment 17 includes an elongated blade member 30. Blade member 30 includes a lower edge or knife section 29 sharpened for cutting and an upper edge or saw section 31 provided with a continuous row of cutting teeth for sawing or the like. Knife 29 curves upwardly at its forward portion 36 terminating at point 38. Blade member 30 is provided with an enlarged shoulder portion 23' having a flat or squared end surface 24', and a threaded male portion 22' projects beyond the shoulder portion and is secured to handle 10 by engagement of threaded male portion 22' with threaded socket 14 to frictionally interlock flat surface 13 of shoulder 12 with the flat surface 24' of shoulder portion 23'.

In using the improved combination tool of the present invention, one must merely interchange the desired head attachment in handle 10. If desired, the dressing tool of handle 10 may be used whether or not the interchangeable head attachments are attached without impairing the ease of use. In either case, the broad area of frictional engagement between the shoulder surfaces greatly lessens the possibility of accidental loosening of the implement when in use. However, each implement can be released from the handle by applying a positive torque or twist to the implement preferably at the shoulder portions in a direction to unthread the implement from the handle.

Although not wishing to be bound by any specific dimension disclosed herein, it is to be understood that such dimensions are given for illustrative purposes only. For example, the overall length of handle 10 may be 5¼ inch having ½-13 threaded socket 14 and offset 18 of 1¼ inches. Attachment 15 and 17 preferably have an overall length of about 5 inches. The hammer portion 27 of head attachment 15 approximates 2 inches by ½ inch. In head attachment 17, the blade member 30 is on the order of 3¾ inches long and 1 5/16th inches wide. The improved combination tool of the present invention may be constructed from any suitable material capable of withstanding the rigors of use of such a tool. It is easily seen that the present invention is compact and readily carried on the person.

It will be appreciated that while the present embodiment 8 shows the dressing tool portion of handle 10 to be an integral part of the handle 10, the dressing tool may be constructed in a manner allowing its detachment and the attachment of other devices including but not limited to the attachments with enlarged shoulder means as described. It is therefore to be understood by those having skill in the art that the above-described embodiment is intended to be merely exemplary, in that it is susceptible of modification and variation without departing from the spirit and scope of the invention as set forth in the appended claims.

What is claimed is:

1. In a combination hand tool adapted for interchangeable, releasable attachment of implements thereto in which each implement is provided at one end with a male connecting portion and an enlarged shoulder having a correspondingly enlarged, squared end surface facing toward the male connecting portion, the combination therewith comprising:

a handle including hand gripping means and a first shoulder portion at the forward end of said handle enlarged with respect to said hand gripping means, said first enlarged shoulder portion having a correspondingly enlarged, squared end surface facing in a forward direction away from said hand gripping means and socket means in the forward extremity of said handle adapted for insertion and detachable connection of the male connecting portion on the implement, the enlarged, square end surface of the shoulder portion on each implement adapted to frictionally engage said enlarged, squared end surface on said first shoulder portion when the male connecting portion is fully inserted into said socket means; and a second shoulder portion on said handle at the rearward end of said handle enlarged with respect to said hand gripping means, said shoulder portion at the rearward end of said hand gripping means converging rearwardly away from said hand gripping means into a reverse curved, forwardly directed knife, the cutting edge of said knife being spaced from and in facing relation to said handle, and said knife terminating in an elongated, forwardly projecting end portion with a beveled, slightly pointed tip in parallel, laterally spaced relation to said hand gripping means.

2. In a hand tool according to claim 1, said hand gripping means being in the form of a cylindrical, knurled gripping portion.

3. In a hand tool according to claim 1, in which said enlarged squared end surface of said first shoulder portion is disposed in the plane of the terminal end of said handle, said socket being internally threaded to threadedly receive said male connecting portion and the entrance of said socket being located at the terminal end of said handle, the squared end surface of each implement being movable into flush engagement with the enlarged, squared end surface of said first shoulder portion at the terminal end of said handle.

4. In a combination hand tool 1 including a handle (10) and interchangeable head attachments (15, 17,) comprising:

a solid cylindrical section 11 at the midsection of said handle (10), an external annular shoulder portion (12) at the forward end of said handle (10), said shoulder portion 12 having opposing flat end surfaces (13, 13') and a concentrically oriented, large circumference in relation to said cylindrical section (11), an internally threaded socket (14) in the forward terminal end of said handle (10), and an external shoulder portion (16) at the rearward end of said handle (10) which converges rearwardly toward the longitudinal axis of handle (10) in a generally conical fashion and ultimately extending into a lateral offset (20) provided with a reverse curved forwardly directed knife edge (19) terminating in an elongated, beveled and slightly pointed end portion (18) also extending in a forward direction in radially spaced parallel relation to the longitudinal axis of said handle; and a body portion (26) of said head attachment 15 provided with an enlarged shoulder portion (23) with a correspondingly enlarged flat end surface (24) in relation to the size of said cylindrical section (11) of said handle (10), including an externally threaded male connecting portion (22) for securing said attachment (15) to said handle (10) by full insertion and threaded engagement of said male connecting portion (22) with said internally threaded socket (14) until said end surface (13) of shoulder (12) advances into firm frictional engagement with said flat end surface (24) of shoulder (23).

* * * * *

UNITED STATES PATENT OFFICE

CERTIFICATE OF CORRECTION

Patent No. 4,030,150 Dated June 21, 1977

Inventor(s) Lloyd R. Fisher

It is certified that error appears in the above-identified patent and that said Letters Patent are hereby corrected as shown below:

On the title page, delete "Assignee: Joe W. Page, Jr., Huntington Beach, Calif."

Claim 4, Column 4, line 31, "1" should read -- 8 --.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*